US012680708B2

(12) United States Patent
Sakai et al.

(10) Patent No.: US 12,680,708 B2
(45) Date of Patent: Jul. 14, 2026

(54) AIR CONDITIONER MANAGEMENT SYSTEM AND AIR CONDITIONER MANAGEMENT METHOD

(71) Applicant: Mitsubishi Electric Corporation, Tokyo (JP)

(72) Inventors: Mizuo Sakai, Tokyo (JP); Tetsuya Yamashita, Tokyo (JP); Noka Sakabe, Tokyo (JP); Ryohei Tachiwana, Tokyo (JP); Masahiro Kamijo, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 272 days.

(21) Appl. No.: 18/564,691

(22) PCT Filed: Dec. 7, 2021

(86) PCT No.: PCT/JP2021/044848
§ 371 (c)(1),
(2) Date: Nov. 28, 2023

(87) PCT Pub. No.: WO2023/105608
PCT Pub. Date: Jun. 15, 2023

(65) Prior Publication Data
US 2024/0271809 A1 Aug. 15, 2024

(51) Int. Cl.
*F24F 11/32* (2018.01)
*F24F 11/56* (2018.01)
*F24F 110/12* (2018.01)

(52) U.S. Cl.
CPC ..... *F24F 11/32* (2018.01); *F24F 11/56* (2018.01); *F24F 2110/12* (2018.01)

(58) Field of Classification Search
CPC ..... F24F 11/32; F24F 11/56; F24F 2110/12; F24F 11/61; G05D 1/00; G05D 1/0011;
(Continued)

(56) References Cited

U.S. PATENT DOCUMENTS 5,983,161 A * 11/1999 Lemelson ..... G01S 19/11 340/436
8,989,922 B2 * 3/2015 Jones ..... B64U 10/16 701/3

(Continued)

FOREIGN PATENT DOCUMENTS

JP 2002-277027 A 9/2002
JP 2018-194949 A 12/2018

(Continued)

OTHER PUBLICATIONS

International Search Report of the International Searching Authority mailed Jan. 18, 2022 issued in corresponding International Patent Application No. PCT/JP2021/044848 (and English translation).

*Primary Examiner* — Kun Kai Ma
(74) *Attorney, Agent, or Firm* — Posz Law Group, PLC

(57) ABSTRACT

Provided is an air conditioner management system including an air conditioner and an aircraft. The air conditioner includes a position information provider configured to provide position information indicating a position of the air conditioner. The aircraft includes: a position information acquisitor configured to acquire the position information provided; and a measurer configured to perform a measurement regarding the air conditioner, based on the position information acquired. Thereby, it is possible to measure a specific air conditioner.

20 Claims, 8 Drawing Sheets

(58) Field of Classification Search
CPC ..... G05D 1/0022; G05D 1/0285; H04L 12/2814; H04L 12/2834; H04L 41/082; G08K 5/006; G08K 5/003; G08K 5/0021; G06K 9/0063; H04W 4/80
See application file for complete search history.

(56) References Cited

U.S. PATENT DOCUMENTS

| | | | | |
|---|---|---|---|---|
| 10,741,087 | B1 * | 8/2020 | Picardi | G08G 5/55 |
| 11,049,404 | B2 * | 6/2021 | Gorsica | G08G 5/55 |
| 2017/0205827 | A1 * | 7/2017 | Rezvani | G08B 13/1965 |
| 2017/0276833 | A1 * | 9/2017 | Narabu | H04N 23/57 |
| 2018/0058712 | A1 * | 3/2018 | Miyaura | F24F 11/30 |
| 2019/0215179 | A1 * | 7/2019 | Mannfeld | H04L 12/2834 |
| 2019/0265707 | A1 * | 8/2019 | Cantrell | G05D 1/101 |
| 2020/0058001 | A1 | 2/2020 | Naritake et al. | |
| 2021/0004001 | A1 * | 1/2021 | Kaneda | H04Q 9/00 |
| 2021/0011443 | A1 * | 1/2021 | Mcnamara | F24F 11/61 |
| 2021/0095880 | A1 * | 4/2021 | Boothroyd | F24F 11/0001 |
| 2022/0067337 | A1 * | 3/2022 | Rezvani | G08G 5/30 |
| 2022/0101507 | A1 * | 3/2022 | Tournier | G06Q 50/163 |
| 2023/0025402 | A1 * | 1/2023 | Zou | H05B 6/688 |

FOREIGN PATENT DOCUMENTS

| | | | | |
|---|---|---|---|---|
| JP | 2019-196980 | A | 11/2019 | |
| JP | 2020-193743 | A | 12/2020 | |
| KR | 101552508 | B1 * | 9/2015 | B64F 1/18 |
| WO | WO-2020110378 | A1 * | 6/2020 | F24F 5/00 |

* cited by examiner

AIR CONDITIONER MANAGEMENT SYSTEM AND AIR CONDITIONER MANAGEMENT METHOD

CROSS REFERENCE TO RELATED APPLICATION

This application is a U.S. national stage application of PCT/JP2021/044848 filed on Dec. 7, 2021, the contents of which are incorporated herein by reference.

TECHNICAL FIELD

The present disclosure relates to an air conditioner management system and an air conditioner management method.

BACKGROUND

Conventionally, there is an information generation system that identifies an outdoor unit of an air conditioner from landscape image data associated with position information, such as images taken from airplanes, drones, and satellites, and images provided by map services on the Internet, and identifies an installation position of the outdoor unit based on the position information associated with the image data. Further, this information generation system distinguishes and identifies an image of the identified outdoor unit based on a degree of deterioration or a type of deterioration (see, for example, Patent Document 1).

Patent Document

[Patent Document 1] Japanese Patent Application Publication No. 2018-194949

However, since the conventional information generation system generates information on the air conditioner identified from the image data, there is a problem that it is uncertain that a measurement result for which air conditioner will be obtained, as a result of the measurement of the degree of deterioration or the like.

SUMMARY

The present disclosure has been made in view of such circumstances, and provides an air conditioner management system, an air conditioner management method, an air conditioner, a management device, and an aircraft which can measure a specific air conditioner.

The present disclosure has been made to solve the above problem. An air conditioner management system according to an aspect of the present invention includes an air conditioner and an aircraft. The air conditioner includes a position information provider configured to provide position information indicating a position of the air conditioner. The aircraft includes: a position information acquisitor configured to acquire the position information provided; and a measurer configured to perform a measurement regarding the air conditioner, based on the position information acquired.

Further, in the air conditioner management system according to another aspect of the present invention, the air conditioner includes an abnormality detector configured to detect an abnormality in the air conditioner. The position information provider is configured to provide the position information when the abnormality detector detects the abnormality.

Further, in the air conditioner management system according to another aspect of the present invention, the position information provider is configured to provide the position of the air conditioner detected by a positioning system as the position information, or provide the position information by emitting a radio wave to signal the position of the air conditioner.

Further, the air conditioner management system according to another aspect of the present invention includes a management device configured to store the position information in association with identification information. The position information provider is configured to transmit the identification information to the management device. The management device is configured to transmit to the aircraft, the position information associated with the identification information transmitted.

Further, in the air conditioner management system according to another aspect of the present invention, the measurer is configured to measure an outside temperature or an indoor temperature, and a temperature near an intake port of the air conditioner. The management device is configured to determine that the air conditioner is in a short cycle state when an absolute value of a temperature difference between the outside temperature or the indoor temperature and the temperature near the intake port, which are measured by the measurer, is not less than a predetermined threshold, or is not equal to or less than the predetermined threshold.

Further, an air conditioner management method according to another aspect of the present invention includes: a step of an air conditioner providing position information indicating a position of the air conditioner; a step of an aircraft acquiring the position information provided; and a step of the aircraft performing a measurement regarding the air conditioner, based on the position information acquired.

Further, an air conditioner according to another aspect of the present invention includes a position information provider configured to provide position information indicating a position of the air conditioner.

Further, a management device according to another aspect of the present invention includes: a storage configured to store position information of an air conditioner in association with identification information of the air conditioner; and a communication unit configured to transmit to an aircraft, the position information associated with the identification information transmitted from the air conditioner.

Further, an aircraft according to another aspect of the present invention includes: a position information acquisitor configured to acquire position information provided by an air conditioner; and a measurer configured to perform a measurement regarding the air conditioner, based on the position information acquired.

The air conditioner management system of the present disclosure can measure a specific air conditioner.

DETAILED DESCRIPTION

Figure 1:
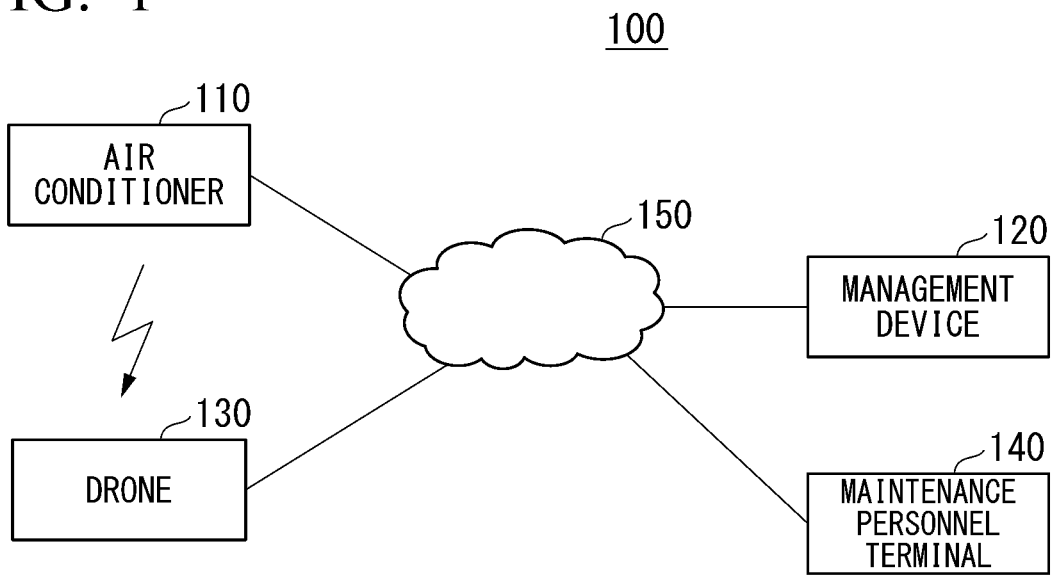
FIG. 1 is a schematic block diagram showing a configuration of an air conditioner management system 100 in an embodiment of the present disclosure.

Hereinafter, embodiments of the present disclosure will be described with reference to the drawings. FIG. 1 is a schematic block diagram showing a configuration of an air conditioner management system 100 in the present embodiment. The air conditioner management system 100 is used, for example, when a maintenance personnel of an air conditioner 110 performs an inspection when an abnormality occurs in the air conditioner 110 or performs periodic inspections. The air conditioner management system 100 includes the air conditioner 110, a management device 120, a drone 130, and a maintenance personnel terminal 140. Through a network 150 such as the Internet, at least the management device 120 is communicatively connected to the air conditioner 110, the drone 130, and the maintenance personnel terminal 140. Note that devices other than the management device 120 may also be communicatively connected to each other via the network 150. Further, the air conditioner management system 100 may include a plurality of air conditioners 110, and may include a plurality of drones 130.

The air conditioner 110 is an air conditioner that cools or heats indoor air. The air conditioner 110 includes an indoor unit installed indoors and an outdoor unit installed outdoors. The air conditioner 110 includes a position information provider that provides position information indicating a position of the air conditioner 110. In FIG. 1, the position information provider is not shown, and details thereof will be described later. Note that in the present embodiment, the position of the air conditioner 110 indicated by the position information is the position of the outdoor unit of the air conditioner 110. However, the position information may indicate positions of other components of the air conditioner 110. For example, the position information may indicate a position of an indoor unit that constitutes the air conditioner 110 and is installed indoors.

The management device 120 manages the air conditioner 110 and the drone 130. The management device 120 receives information indicating an abnormality or information indicating a position from the air conditioner 110, and notifies the drone 130 of position information indicating a position of the air conditioner 110. Further, the management device 120 determines a state of the air conditioner 110 based on measurement information received from the drone 130, and transmits a result of the determination to the maintenance personnel terminal 140.

The drone 130 is an autonomous flying drone (aircraft). The drone 130 may be a quadcopter, a helicopter, or a drone that flies by other methods. The drone 130 includes a position information acquisitor that acquires the position information provided by the air conditioner 110, and a measurer that performs a measurement regarding the air conditioner 110 based on the position information. In FIG. 1, the position information acquisitor and the measurer are not shown, and details thereof will be described later.

The maintenance personnel terminal 140 may be a portable terminal such as a notebook PC (Personal Computer), a tablet terminal, or a smartphone, or may be a stationary terminal such as a desktop PC. The maintenance personnel terminal 140 notifies, by a screen display or the like, the maintenance personnel of the state of the air conditioner 110 notified from the management device 120.

Figure 2:
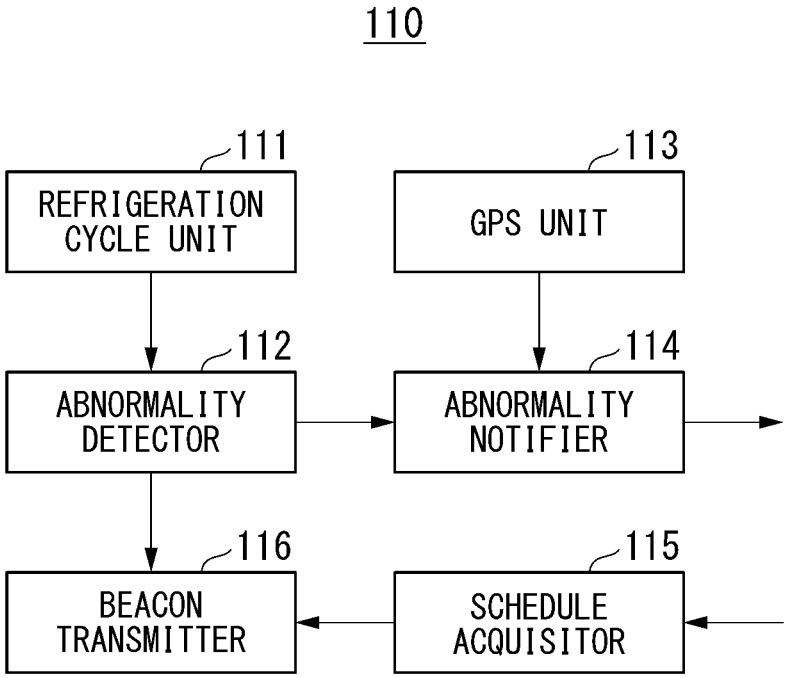
FIG. 2 is a schematic block diagram showing a functional configuration of an air conditioner 110 in the same embodiment.

FIG. 2 is a schematic block diagram showing a functional configuration of the air conditioner 110 in the present embodiment. The air conditioner 110 includes a refrigeration cycle unit 111, an abnormality detector 112, a GPS (Global Positioning System) unit 113, an abnormality notifier 114, a schedule acquisitor 115, and a beacon transmitter 116. In the present embodiment, the position information provider of the air conditioner 110 is composed of the beacon transmitter 116, the GPS unit 113, and the abnormality notifier 114. Note that the air conditioner 110 may include only a part of the beacon transmitter 116, the GPS unit 113, and the abnormality notifier 114, and the position information provider may be composed of that part.

The refrigeration cycle unit 111 uses a refrigeration cycle to cool indoor air during cooling operation and warm indoor air during heating operation. The abnormality detector 112 detects an abnormality in the air conditioner 110 including the refrigeration cycle unit 111. The GPS unit 113 detects a position of the air conditioner 110 using a positioning system such as the GPS. In the present embodiment, the GPS unit 113 detects a position of the outdoor unit of the air conditioner 110 as the position of the outdoor unit of the air conditioner 110, but may detect a position of the indoor unit by an indoor positioning system.

The abnormality notifier 114 transmits to the management device 120, information indicating the abnormality detected by the abnormality detector 112 (for example, an abnormality code). At this time, the abnormality notifier 114 transmits, together with the information indicating the abnormality, information indicating the position of the air conditioner 110 detected by the GPS unit 113, and information identifying a body of the air conditioner 110. The schedule acquisitor 115 acquires from the management device 120, information indicating a schedule for the drone 130 to perform a measurement regarding the air conditioner 110. According to the schedule indicated by the acquired information, the schedule acquisitor 115 may control the refrigeration cycle unit 111 so that the air conditioner 110 performs operation such as cooling, heating, or the like, when a measurement regarding the air conditioner 110 is performed. At this time, a type of operation to be performed may be predetermined depending on the season, or may be included in the information indicating the schedule for performing the measurement.

The beacon transmitter 116 emits a radio wave (beacon) to signal the position of the air conditioner 110 according to the schedule acquired by the schedule acquirer 115. Note that when the abnormality detector 112 detects an abnormality or when the abnormality notifier 114 notifies the abnormality, the beacon transmitter 116 may transmit the beacon for a certain period of time or until a stop instruction is given. The stop instruction may be received from the management device 120 or from the drone 130. Further, the beacon may include the information identifying the body of the air conditioner 110. The beacon transmitted by the beacon transmitter 116 may be a beacon signal using the Bluetooth (registered trademark).

Figure 3:
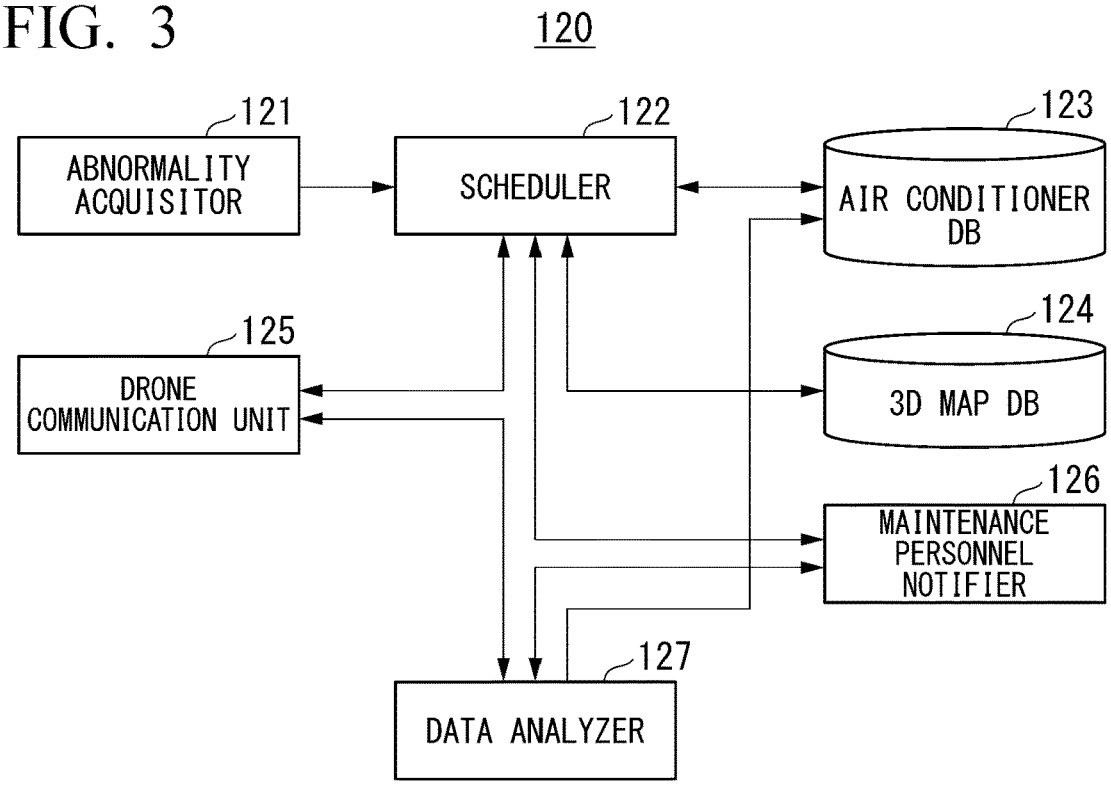
FIG. 3 is a schematic block diagram showing a functional configuration of a management device 120 in the same embodiment.

FIG. 3 is a schematic block diagram showing a functional configuration of the management device 120 in the present embodiment. The management device 120 includes an abnormality acquisitor 121, a scheduler 122, an air conditioner DB 123 (storage), a 3D map DB 124, a drone communication unit 125 (communication unit), a maintenance personnel notifier 126, and a data analyzer 127. The abnormality acquisitor 121 receives via the network 150, the information indicating the abnormality transmitted by the abnormality notifier 114 of the air conditioner 110, the information indicating the position of the air conditioner 110, and the information identifying the body of the air conditioner 110.

The scheduler 122 determines a position and a schedule for making the drone 130 fly and perform a measurement regarding the air conditioner 110. For example, when the abnormality acquisitor 121 acquires information indicating an abnormality in the air conditioner 110, the scheduler 122 determines a flight route and a flight schedule of the drone 130 from the information indicating the position of the air conditioner 110 that has been acquired together with the information indicating the abnormality, and 3D map information stored in the 3D map DB 124. Note that the scheduler 122 may determine items to be measured by the drone 130 based on the information indicating the abnormality, and may include the items in the flight route. Further, when a periodic inspection date of the air conditioner 110 approaches, the scheduler 122 determines a flight path and a flight schedule of the drone 130 from the information indicating the position of the air conditioner 110 stored in the air conditioner DB 123 and the 3D map information stored in the 3D map DB 124. The flight route and the flight schedule at this time may be for performing measurements regarding a plurality of air conditioners 110. Further, the flight path includes information indicating a position where a measurement regarding the air conditioner 110 is performed, that is, the position information of the air conditioner 110. Further, the scheduler 122 may acquire current weather information and future weather forecast information from weather information services on the Internet or the like, and determine a flight schedule of the drone 130 so as to avoid the flight in stormy weather, such as when wind speed exceeds a threshold or when precipitation exceeds a threshold.

The air conditioner DB 123 stores information indicating a position of the air conditioner 110, information indicating an inspection date of the air conditioner 110, and the like, in association with information identifying a body of the air conditioner 110. The 3D map DB 124 stores 3D map data of a building in which the air conditioner 110 is installed and its surroundings. The drone communication unit 125 communicates with drone 130 via network 150. For example, the drone communication unit 125 transmits the flight route and the flight schedule of the drone 130 determined by the scheduler 122 to the drone 130 via the network 150. Further, the drone communication unit 125 receives a result of the measurement regarding the air conditioner 110 from the drone 130 via the network 150.

The maintenance personnel notifier 126 transmits the flight route and the flight schedule of the drone 130 determined by the scheduler 122 and a result of an analysis by the data analyzer 127 to the maintenance personnel terminal 140 via the network 150. This transmission may be done by email or using other messaging services.

The data analyzer 127 determines a state of the air conditioner 110 based on the result of the measurement regarding the air conditioner 110 received by the drone communication unit 125. For example, the data analyzer 127 uses an external image of the outdoor unit as the result of the measurement to determine whether the outdoor unit is damaged, whether an outdoor air intake port of the outdoor unit is clogged, and the like. Further, the data analyzer 127 determines whether the outdoor unit of the air conditioner 110 is in a short cycle state, based on the result of the measurement. Here, the short cycle state refers to a state in which the outdoor unit sucks in air blown out by the outdoor unit before the temperature sufficiently approaches the outside temperature. Note that in a case of the indoor unit, the short cycle state refers to a state in which the indoor unit sucks in air blown out by the indoor unit before the temperature sufficiently approaches the room temperature. Details of a method for determining whether or not the state is the short cycle state will be described later.

Figure 4:
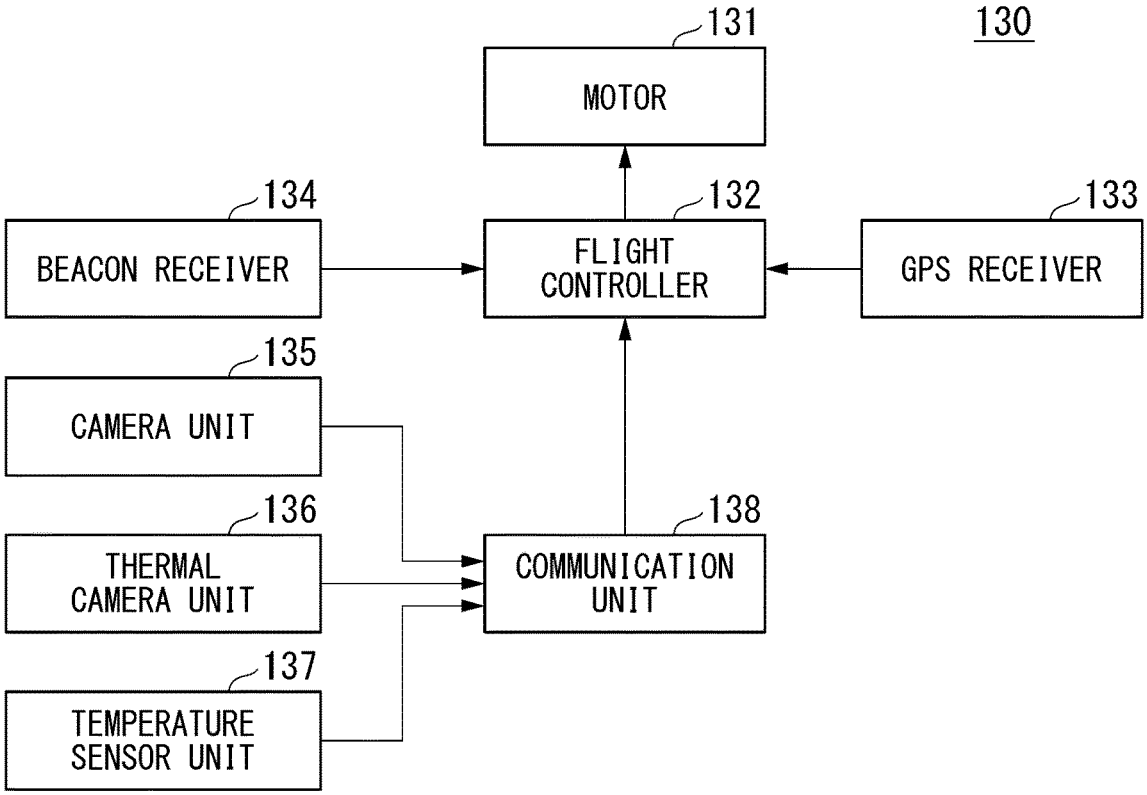
FIG. 4 is a schematic block diagram showing a functional configuration of a drone 130 in the same embodiment.

FIG. 4 is a schematic block diagram showing a functional configuration of the drone 130 in the present embodiment. The drone 130 includes a motor 131, a flight controller 132, a GPS receiver 133, a beacon receiver 134, a camera unit 135, a thermal camera unit 136, a temperature sensor unit 137, and a communication unit 138. In the present embodiment, the beacon receiver 134 and the communication unit 138 function as a position information acquisitor. Further, the camera unit 135, the thermal camera unit 136, and the temperature sensor unit 137 function as a measurer. The motor 131 rotates a rotor for flying the drone 130. The flight controller 132 controls the flight of the drone 130. Specifically, the flight controller 132 controls the rotation of the motor 131 to fly the drone 130 according to the flight route and the flight schedule of the drone 130 determined by the management device 120.

The GPS receiver 133 detects a current position of the drone 130 using a positioning system such as the GPS. The detected current position is used by the flight controller 132 to control the flight of the drone 130. The beacon receiver 134 receives the beacon emitted by the beacon transmitter 116 of the air conditioner 110, and identifies a position of the air conditioner 110 based on the beacon. For example, the beacon receiver 134 includes a highly directional antenna, identifies an arrival direction of the beacon by changing the direction of the drone 130, and identifies a position of the air conditioner 110 based on the arrival directions identified at a plurality of points. Note that the beacon receiver 134 may include an antenna whose directivity can be changed, and identify an arrival direction of the beacon by changing the direction of the directivity. Further, the beacon receiver 134 may determine from which air conditioner 110 the beacon is being transmitted, based on the information identifying the body of the air conditioner 110, which is included in the beacon.

The camera unit 135 captures visible light images. The camera unit 135 captures an exterior of the outdoor unit of the air conditioner 110 and transmits the captured image to the management device 120 via the communication unit 138. The thermal camera unit 136 captures a surface temperature image (thermal image). The thermal camera unit 136 captures a surface temperature image of the outdoor unit of the air conditioner 110 and transmits the captured image to the management device 120 via the communication unit 138. The temperature sensor unit 137 measures a temperature near the drone 130.

The temperature sensor unit 137 measures an outside temperature and a temperature near the intake port of the outdoor unit of the air conditioner 110, and transmits them to the management device 120 via the communication unit 138. The communication unit 138 communicates with the management device 120 via the network 150. As described above, each component constituting the drone 130, such as the flight controller 132, the camera unit 135, the thermal camera unit 136, and the temperature sensor unit 137, communicates with the management device 120 via the communication unit 138.

Figure 5:
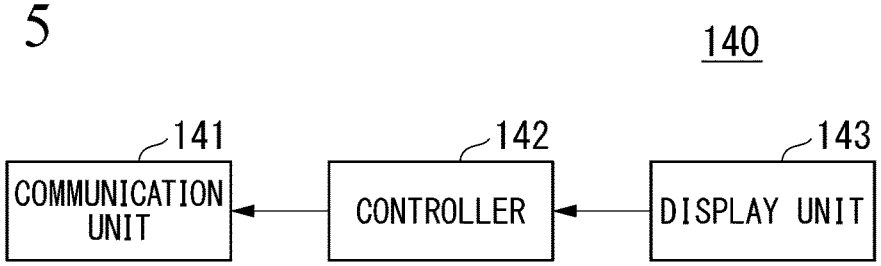
FIG. 5 is a schematic block diagram showing a functional configuration of a maintenance personnel terminal 140 in the same embodiment.

FIG. 5 is a schematic block diagram showing a functional configuration of the maintenance personnel terminal 140 in the present embodiment. The maintenance personnel terminal 140 includes a communication unit 141, a controller 142, and a display unit 143. The communication unit 141 receives from the management device 120, information such as the flight route and the flight schedule of the drone 130, and the result of the analysis by the data analyzer 127. The controller 142 causes the display unit 143 to display the information received by the communication unit 141. The display unit 143 includes a display device such as a liquid crystal display or an organic EL display, and performs display under the control of the controller 142.

Figure 6:
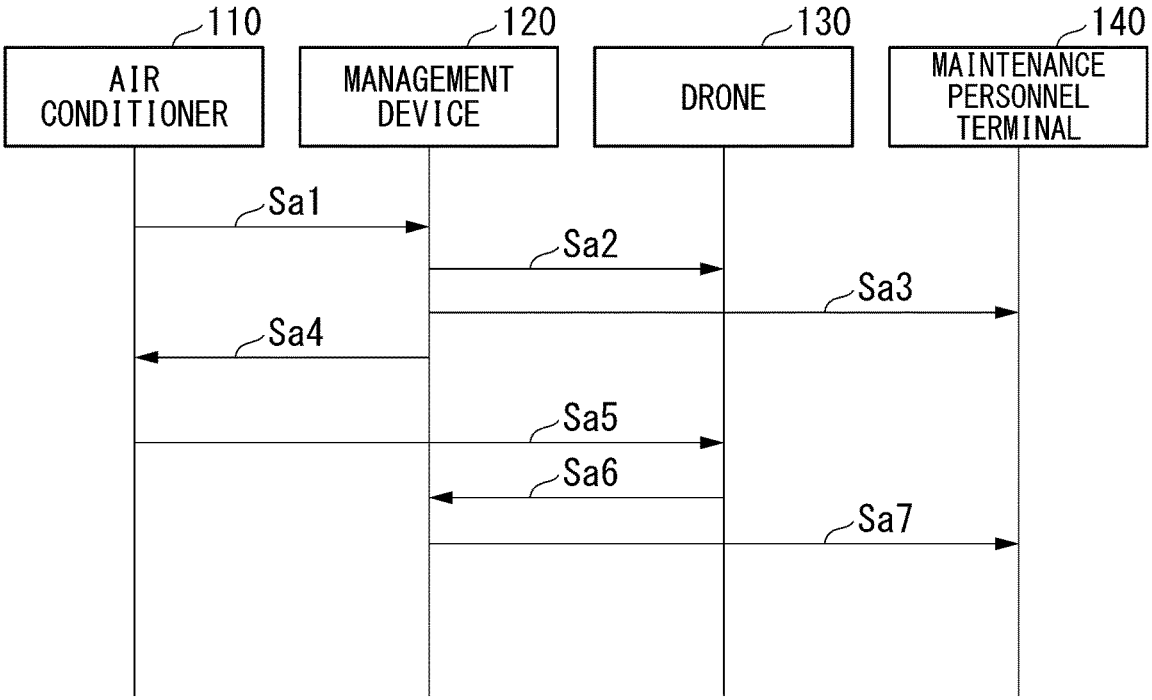
FIG. 6 is a sequence diagram showing a first operation example of the air conditioner management system 100 in the same embodiment.

FIG. 6 is a sequence diagram showing a first operation example of the air conditioner management system 100 in the present embodiment. The first operation example is an operation example in which an abnormality is detected in the air conditioner 110, and a measurement is performed by the drone 130 to confirm the abnormality. First, when the abnormality detector 112 of the air conditioner 110 detects an abnormality, the abnormality notifier 114 of the air conditioner 110 transmits to the management device 120, information indicating the detected abnormality and information indicating a position of the air conditioner 110 (sequence Sa1). When the abnormality acquisitor 121 of the management device 120 acquires these information, the scheduler 122 of the management device 120 determines a flight route and a flight schedule of the drone 130. The scheduler 122 transmits the determined flight route and the determined flight schedule to the drone 130 via the drone communication unit 125 (sequence Sa2). Further, the scheduler 122 transmits to the maintenance personnel terminal 140 via the maintenance personnel notifier 126, the determined flight schedule, the information indicating the abnormality acquired by the abnormality acquisitor 121, and the information identifying the body of the air conditioner 110 (sequence Sa3). Further, the scheduler 122 transmits the determined flight schedule to the air conditioner 110 (sequence Sa4).

When the schedule acquisitor 115 of the air conditioner 110 receives the flight schedule, the refrigeration cycle unit 111 starts operating, and the beacon transmitter 116 starts transmitting a beacon (sequence Sa5). On the other hand, in the drone 130, when its communication unit 138 receives the flight route and the flight schedule, its flight controller 132 controls the motor 131 to fly according to the flight route and the flight schedule. When the drone 130 flies within a range where it can receive the beacon, its beacon receiver 134 receives the beacon and becomes able to identify the position of the air conditioner 110.

When the drone 130 follows the beacon and approaches the outdoor unit of the air conditioner 110, the camera unit 135, the thermal camera unit 136, and the temperature sensor unit 137 respectively measure an external image of the outdoor unit, a surface temperature image, and an air temperature (surrounding air temperature, temperature near the intake port) and transmit results of these measurements to the management device 120 via the communication unit 138 (sequence Sa6). Upon receiving the results of the measurements via the drone communication unit 125, the data analyzer 127 of the management device 120 determines a state of the air conditioner 110 based on the results of the measurements. The data analyzer 127 transmits the determined state of the air conditioner 110 to the maintenance personnel terminal 140 via the maintenance personnel notifier 126 (sequence Sa7). Upon receiving the state of the air conditioner 110, the maintenance personnel terminal 140 displays an image or a text indicating the state on the display unit 143 in order to notify the maintenance personnel.

Note that in sequence Sa1, identification information stored in the air conditioner DB 123 in association with the information indicating the position may be transmitted as the information indicating the position of the air conditioner 110. In the present embodiment, the identification information is information identifying the body of the air conditioner 110. In this case, the scheduler 122 reads from the air conditioner DB the information indicating the position associated with the information identifying the body 123, and determines a flight route and a flight schedule of the drone 130.

Further, in the sequence Sa4, the flight schedule is transmitted, but instructions on transmission of the beacon and starting of the operation may be transmitted at a timing according to the flight schedule of the drone 130.

Figure 7:
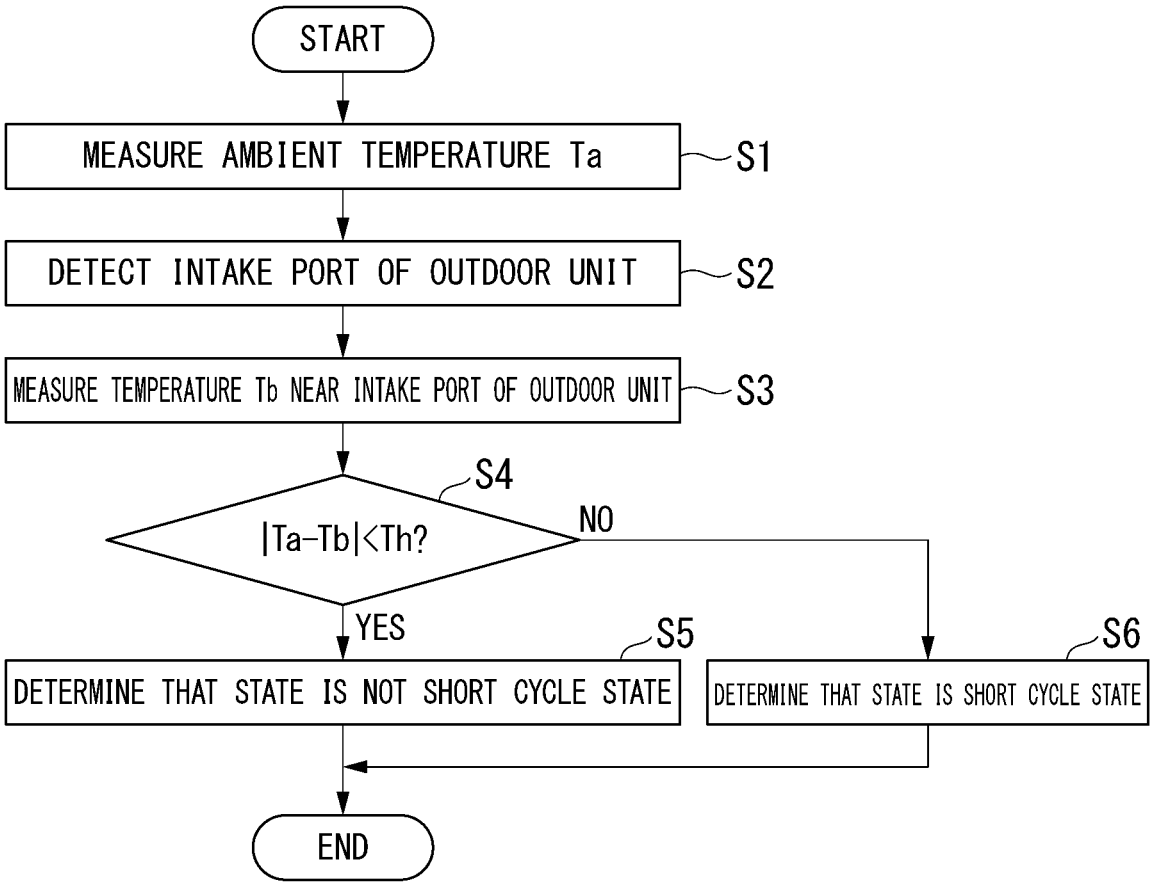
FIG. 7 is a flowchart illustrating short cycle state determination processing in the same embodiment.

FIG. 7 is a flowchart illustrating short cycle state determination processing in the present embodiment. First, the temperature sensor unit 137 of the drone 130 measures an ambient temperature Ta (step S1). The ambient temperature Ta is an air temperature measured by the temperature sensor unit 137 when the drone 130 is at a sufficient distance from the intake port of the outdoor unit, such as a predetermined distance from the outdoor unit of the air conditioner 110. A position at which the ambient temperature Ta is measured may be determined by the scheduler 122 and included in the flight route, or may be determined so as to be a predetermined distance from the outdoor unit, by the drone 130 that has estimated the distance to the outdoor unit from the state of the reception by the beacon receiver 134, the image captured by the camera unit 135, or the image captured by the thermal camera unit 136.

Next, the drone 130 detects the intake port of the outdoor unit from the image captured by the camera unit 135 or the image captured by the thermal camera unit 136 (step S2), and moves to a vicinity of the intake port. The temperature sensor unit 137 of the drone 130 measures an air temperature (temperature Tb) near the intake port (step S3). The data analyzer 127, which has acquired the ambient temperature Ta and the temperature Tb near the intake port transmitted from the drone 130, determines whether an absolute value of a difference ($|Ta-Tb|$) is less than a predetermined threshold Th (step S4). When determining that $|Ta-Tb|$ is less than the threshold Th (step S4—YES), the data analyzer 127 determines that the air conditioner 110 is not in the short cycle state (step S5). When determining that $|Ta-Tb|$ is not less than the threshold Th (step S4—NO), the data analyzer 127 determines that the air conditioner 110 is in the short cycle state (step S6).

Here, in steps S2 and S3, the drone 130 detects the intake port of the outdoor unit, moves to the vicinity of the intake port, and measures the temperature Tb. The temperature Tb may be measured by other methods. For example, the data analyzer 127 may detect the intake port from the thermal image of the outdoor unit captured by the thermal camera unit 136, and set the temperature (surface temperature) near the intake port indicated by the thermal image as the temperature Tb. Further, in step S4, the data analyzer 127 determines whether |Ta−Tb| is less than the threshold Th, but may determine whether |Ta−Tb| is equal to or less than the threshold Th.

Figure 8:
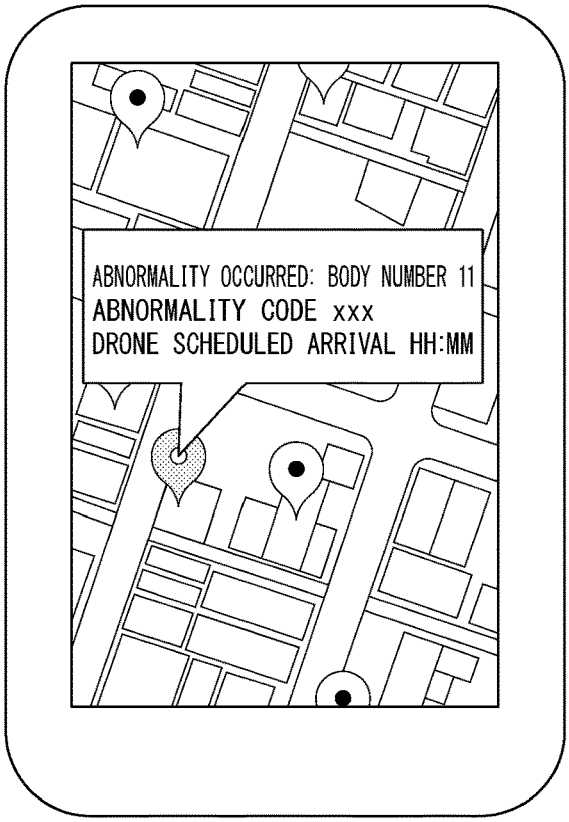
FIG. 8 is a schematic diagram showing a first display example of the maintenance personnel terminal 140 in the same embodiment.

FIG. 8 is a schematic diagram showing a first display example of the maintenance personnel terminal 140 in the present embodiment. The example in FIG. 8 is an example of an image displayed by the maintenance personnel terminal 140 that has acquired the flight schedule, the information indicating the abnormality, and the information identifying the body of the air conditioner 110 in the sequence Sa3 of FIG. 6. In FIG. 7, "Abnormality Occurred: Body Number 11," "Abnormality Code xxx," and "Drone Scheduled Arrival HH:MM" are displayed in a speech bubble at the position where the outdoor unit is installed on the map. As a result, the maintenance personnel can understand that an abnormality has occurred in the air conditioner 110 of the body number 11, that the content of the abnormality is the abnormality code xxx, and that the drone is scheduled to arrive at time HH:MM and perform measurements.

Figure 9:
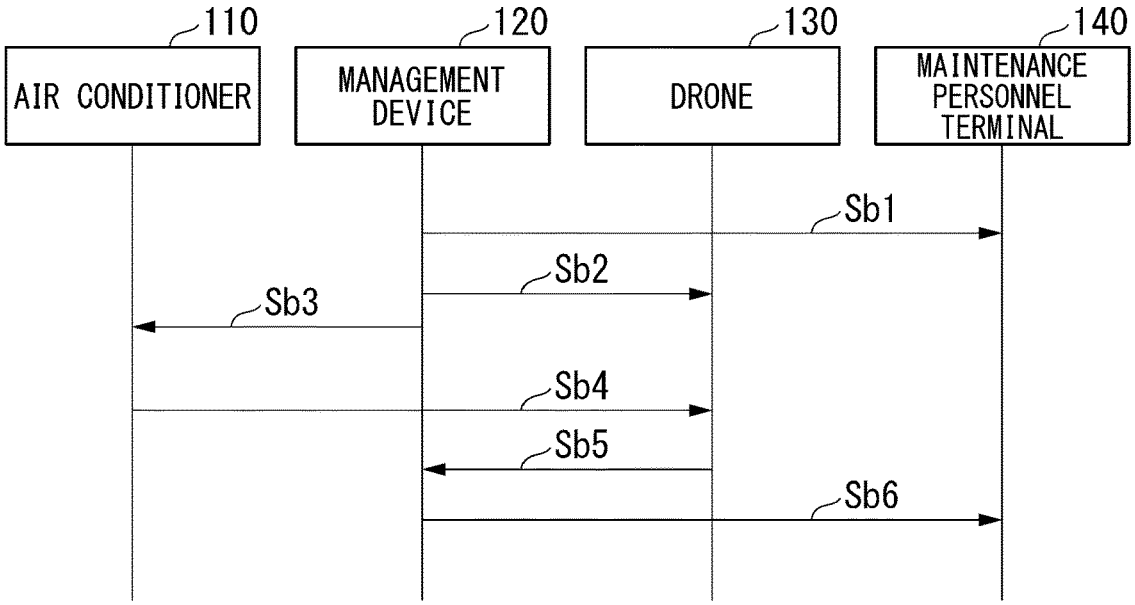
FIG. 9 is a sequence diagram showing a second operation example of the air conditioner management system 100 in the same embodiment.
Figure 10:
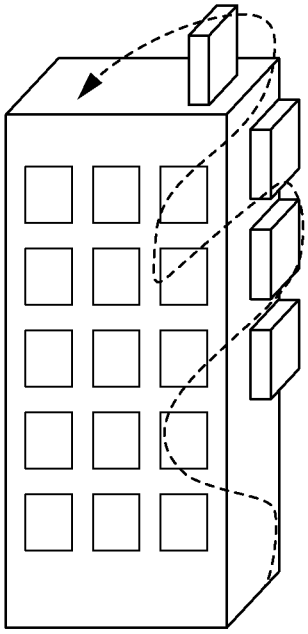
FIG. 10 is a schematic diagram showing an example of a flight path in the same embodiment.
Figure 11:
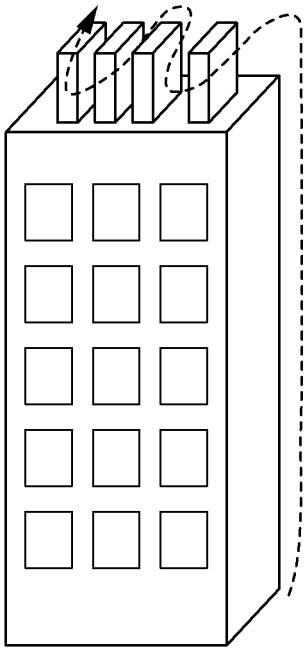
FIG. 11 is a schematic diagram showing an example of a flight path in the same embodiment.
Figure 12:
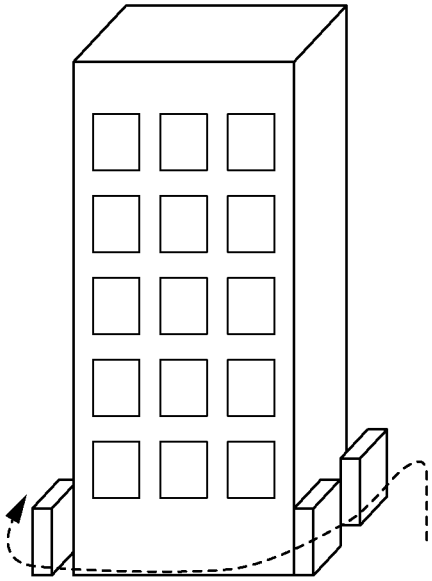
FIG. 12 is a schematic diagram showing an example of a flight path in the same embodiment.
Figure 13:
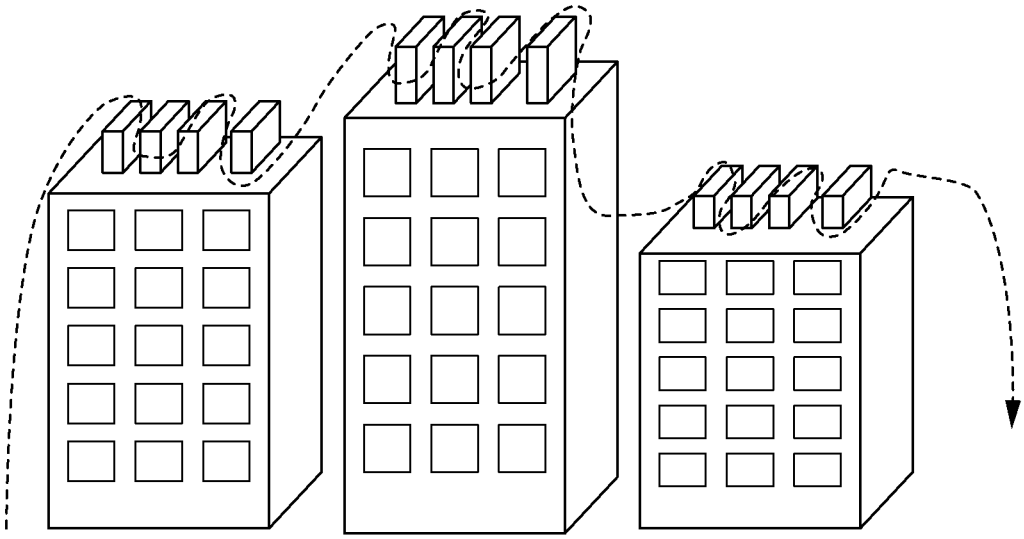
FIG. 13 is a schematic diagram showing an example of a flight path in the same embodiment.

FIG. 9 is a sequence diagram showing a second operation example of the air conditioner management system 100 in the present embodiment. The second operation example is an operation example in which no information indicating an abnormality is received from the air conditioner 110, but the drone 130 performs measurements for inspections planned by the maintenance personnel, periodic inspections, or the like. First, when the maintenance personnel sets information identifying the air conditioner 110 to be inspected, or when the scheduler 122 detects the air conditioner 110 to be inspected in a periodic inspection, the scheduler 122 determines a flight route and a flight schedule of the drone 130 corresponding to the inspection target. At this time, the scheduler 122 uses the information indicating the position of the air conditioner 110 stored in the air conditioner DB 123 in association with the information identifying the air conditioner 110, and the 3D map information stored in the 3D map DB 124. The scheduler 122 transmits the determined flight schedule and the information identifying the body of the air conditioner 110 to the maintenance personnel terminal 140 via the maintenance personnel notifier 126 (sequence Sb1). Further, the scheduler 122 transmits the determined flight route and the determined flight schedule to the drone 130 via the drone communication unit 125 (sequence Sb2). Further, the scheduler 122 transmits the determined flight schedule to the air conditioner 110 (sequence Sb3).

When the schedule acquisitor 115 of the air conditioner 110 receives the flight schedule, the refrigeration cycle unit 111 starts operating, and the beacon transmitter 116 starts transmitting a beacon (sequence Sb4). On the other hand, in the drone 130, when its communication unit 138 receives the flight route and the flight schedule, its flight controller 132 controls the motor 131 to fly according to the flight route and the flight schedule. When the drone 130 flies within a range where it can receive the beacon, its beacon receiver 134 receives the beacon and becomes able to identify the position of the air conditioner 110.

When the drone 130 follows the beacon and approaches the outdoor unit of the air conditioner 110, the camera unit 135, the thermal camera unit 136, and the temperature sensor unit 137 respectively measure an external image of the outdoor unit, a surface temperature image, and an air temperature (surrounding air temperature, temperature near the intake port), and transmit results of these measurements to the management device 120 via the communication unit 138 (sequence Sb5). Upon receiving the results of the measurements via the drone communication unit 125, the data analyzer 127 of the management device 120 determines a state of the air conditioner 110 based on the results of the measurements. The data analyzer 127 transmits the determined state of the air conditioner 110 to the maintenance personnel terminal 140 via the maintenance personnel notifier 126 (sequence Sb6). Upon receiving the state of the air conditioner 110, the maintenance personnel terminal 140 displays an image or a text indicating the state on the display unit 143 in order to notify the maintenance personnel.

Further, in the sequence Sb3, the flight schedule is transmitted, but instructions on transmission of the beacon and starting of the operation may be transmitted at a timing according to the flight schedule of the drone 130.

Each of FIGS. 10, 11, 12, and 13 is a schematic diagram showing an example of a flight path in the present embodiment. In the example shown in FIG. 10, the scheduler 122 determines a flight path so as to perform measurements regarding a plurality of outdoor units installed on a wall and a rooftop of one building. In the example shown in FIG. 11, the scheduler 122 determines a flight path so as to perform measurements regarding a plurality of outdoor units installed on a rooftop of one building. In the example shown in FIG. 12, the scheduler 122 determines a flight path so as to perform measurements regarding a plurality of outdoor units installed on the ground near one building. In the example shown in FIG. 13, the scheduler 122 determines a flight path so as to perform measurements regarding a plurality of outdoor units installed on a plurality of buildings.

Figure 14:
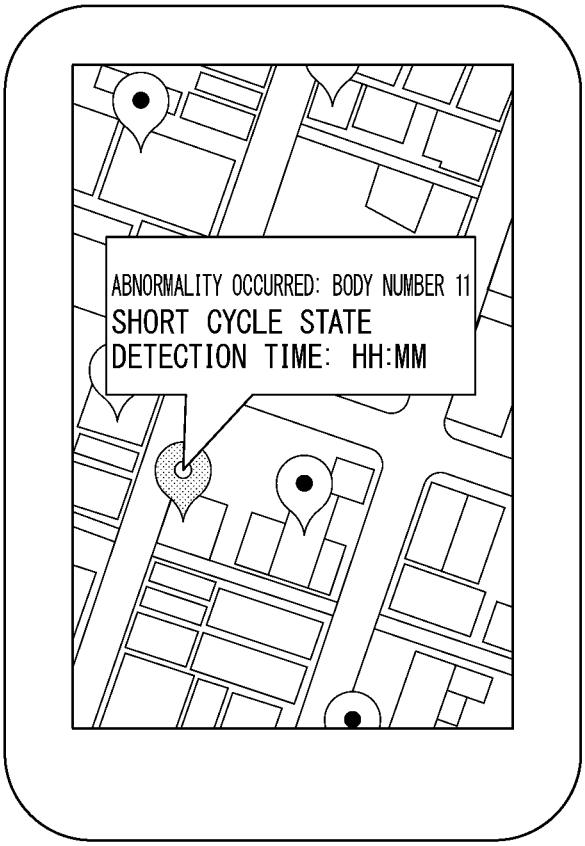
FIG. 14 is a schematic diagram showing a second display example of the maintenance personnel terminal 140 in the same embodiment.

FIG. 14 is a schematic diagram showing a second display example of the maintenance personnel terminal 140 in the present embodiment. The example in FIG. 14 is an example of an image displayed by the maintenance personnel terminal 140 that has acquired the state of the air conditioner 110 by the sequence Sa7 in FIG. 6 or the sequence Sb6 in FIG. 9. In FIG. 14, "Abnormality Occurred: Body Number 11," "Short Cycle State," and "Detection Time: HH:MM" are displayed in a speech bubble at the position where the outdoor unit is installed on the map. As a result, the maintenance personnel can understand that the air conditioner 110 of the body number 11 is in the short cycle state and that this state was detected at HH:MM.

Note that in the above-described embodiment, the drone 130 performs the measurements regarding the outdoor unit of the air conditioner 110, but for example, the drone 130 may perform measurements regarding the indoor unit of the air conditioner 110 installed in a facility with a large indoor space such as an arena. In that case, the GPS unit 113 and the beacon transmitter 116 are installed in the indoor unit, and the GPS unit 113 uses a positioning system for indoor use. Further, when determining a short cycle state, the indoor air temperature is used as the temperature Ta, and the temperature near the intake port of the indoor unit is used as the temperature Tb.

In this way, the air conditioner management system 100 includes the air conditioner 110 and the drone 130. Further, the air conditioner 110 includes a position information provider configured to provide position information indicating a position of the air conditioner. The drone 130 includes a position information acquisitor configured to acquire the position information provided, and a measurer configured to perform a measurement regarding the air conditioner 110. As a result, in the air conditioner management system 100, an air conditioner, such as an air conditioner in which an abnormality has occurred or an air conditioner targeted for a periodic inspection, provides position information indicating a position of the air conditioner, and the drone 130 performs measurements regarding the air conditioner, thereby making it possible to measure the specific air conditioner providing the position information.

Further, a program for realizing the functions of the management device 120, the drone 130, or the maintenance personnel terminal 140 in FIG. 1 may be recorded in a computer-readable recording medium, so that a computer system reads and executes the program recorded in the recording medium to realize the management device 120, the drone 130, or the maintenance personnel terminal 140. Note that the "computer system" referred to herein includes an OS or hardware such as peripheral devices.

Further, the "computer-readable recording medium" refers to portable media such as flexible disks, magneto-optical disks, ROMs, CD-ROMs, and DVDs, and storage devices such as hard disks and SSDs built into computer systems. Further, a "computer-readable recording medium" includes: one that dynamically retains a program for a short period of time, such as a communication line in a case where a program is transmitted via a network such as the Internet or a communication line such as a telephone line; and one that retains a program for a certain period of time, such as a volatile memory inside a computer system that serves as a server or a client in the above case. Further, the above-described program may be one for realizing a part of the above-described functions, or may be one that can realize the above-described functions in combination with a program already recorded in the computer system.

Further, each functional block of the air conditioner 110 in FIG. 2 or the drone 130 in FIG. 4 described above may be individually formed into a chip, or a part or all of them may be integrated into a chip. Moreover, the integrated circuit is not limited to an LSI, but may be implemented as a dedicated circuit or a general-purpose processor. Either hybrid or monolithic is fine. Some of the functions may be realized by hardware and some by software.

Additionally, if an integrated circuit technology or the like that replaces the LSI emerges due to advances in the semiconductor technology, it is also possible to use integrated circuits based on that technology.

Although the embodiments of the present invention have been described above in detail with reference to the drawings, the specific configuration is not limited to these embodiments, and may include design changes without departing from the gist of the present invention.

The invention claimed is:

1. An air conditioner management system comprising:
an air conditioner; and
an aircraft,
wherein the air conditioner comprises at least one air conditioner circuit and/or processor configured to:
transmit, via a beacon transmitter to the aircraft, position information indicating a position of the air conditioner,
receive a flight schedule for making the aircraft fly and perform a measurement regarding the air conditioner, and
start the air conditioner to perform air conditioning in accordance with the flight schedule,
wherein the aircraft comprises at least one aircraft circuit and/or processor configured to:
receive the flight schedule and fly the aircraft in accordance with the flight schedule, and
receive, via a beacon receiver, the position information which is transmitted from the air conditioner; and
perform the measurement, using a camera, a thermal camera, or a sensor, regarding the air conditioner, based on the position information which is received from the air conditioner.

2. The air conditioner management system of claim 1,
wherein the at least one air conditioner circuit and/or processor is further configured to:
detect an abnormality in the air conditioner, and
transmit the position information in response to the abnormality being detected.

3. The air conditioner management system of claim 1,
wherein the at least one air conditioner circuit and/or processor is configured to provide the position of the air conditioner that is detected by a global positioning system of the air conditioner as the position information.

4. The air conditioner management system of claim 1, comprising:
at least one management processor configured to store, in a storage, the position information in association with identification information of the air conditioner,
wherein the at least one air conditioner circuit and/or processor is configured to transmit the identification information to the at least one management processor, and
wherein the at least one management processor is configured to receive, from the at least one air conditioner circuit and/or processor, the identification information and transmit, to the aircraft, the position information associated with the identification information which is received.

5. The air conditioner management system of claim 1,
wherein the at least one aircraft circuit and/or processor is configured to measure an outside temperature or an indoor temperature, and a temperature near an intake port of the air conditioner, and
wherein at least one management processor is configured to determine that the air conditioner is in a short cycle state when an absolute value of a temperature difference between the outside temperature or the indoor temperature and the temperature near the intake port, which are measured by the at least one aircraft circuit and/or processor, is not less than a predetermined threshold, or is not equal to or less than the predetermined threshold.

6. An air conditioner management method comprising:
providing from an air conditioner to an aircraft, position information indicating a position of the air conditioner;
receiving, at the air conditioner, a flight schedule for making the aircraft fly and perform a measurement regarding the air conditioner,
receiving at the aircraft the flight schedule,
starting, by the air conditioner, to perform air conditioning in accordance with the flight schedule,
flying, by the aircraft, the aircraft in accordance with the flight schedule, and performing a measurement regarding the air conditioner, using the aircraft, based on the position information received by the aircraft from the air conditioner.

7. The air conditioner management system of claim 1, wherein the at least one air conditioner circuit and/or processor is configured to provide the position information by emitting a radio wave to signal the position of the air conditioner.

8. The air conditioner management method of claim 6, further comprising:

detecting an abnormality in the air conditioner, wherein the position information is provided when the abnormality is detected.

9. The air conditioner management method of claim 6, wherein providing the position information comprises detecting the position of the air conditioner by a positioning system.

10. The air conditioner management method of claim 6, wherein providing the position information comprises emitting a radio wave to signal the position of the air conditioner.

11. The air conditioner management method of claim 6, further comprising:

transmitting identification information of the air conditioner from the air conditioner to a management device storing the position information in association with the identification information; and transmitting from the management device to the aircraft, the position information associated with the identification information.

12. The air conditioner management method of claim 6, further comprising:

measuring, using the aircraft, an outside temperature or an indoor temperature, and a temperature near an intake port of the air conditioner; and determining that the air conditioner is in a short cycle state when an absolute value of a temperature difference between the outside temperature or the indoor temperature and the temperature near the intake port is not less than a predetermined threshold, or is not equal to or less than the predetermined threshold.

13. The air conditioner management system according to claim 1, wherein the at least one air conditioner circuit and/or processor is further configured to transmit, via the beacon transmitter, the position information at a timing according to the flight schedule.

14. The air conditioner management system according to claim 1, wherein the at least one aircraft circuit and/or processor is configured to:

in response to receiving the position information via the beacon receiver, approach the air conditioner and then perform the measurement, and transmit, via a communication network, a result of the measurement to at least one management processor for analyzing a state of the air conditioner.

15. The air conditioner management system according to claim 1, wherein:

the flight schedule is determined in association with a flight path indicating a route for flying the aircraft for obtaining a plurality of measurements regarding a plurality of air conditioners including the measurement regarding the air conditioner, and the at least one aircraft circuit and/or processor is further configured to fly the aircraft in accordance with the flight path in addition to the flight schedule.

16. The air conditioner management system according to claim 1, further comprising:

at least one management processor configured to determine the flight schedule, transmit the flight schedule, via a communication network, to the air conditioner and to the aircraft, receive, via the communication network, from the aircraft, the measurement regarding the air conditioner, determine a state of the air conditioner, and initiate maintenance on the air conditioner based on the state which is determined.

17. The air conditioner management method according to claim 6, further comprising:

transmitting, via a beacon transmitter of the air conditioner, the position information at a timing according to the flight schedule.

18. The air conditioner management method according to claim 6, further comprising:

approaching, by the aircraft, in response to receiving the position information via a beacon receiver of the air conditioner, the air conditioner and then performing the measurement, and transmitting, by the aircraft, via a communication network, a result of the measurement to at least one management processor for analyzing a state of the air conditioner.

19. The air conditioner management method according to claim 6, wherein the flight schedule is determined in association with a flight path indicating a route for flying the aircraft for obtaining a plurality of measurements regarding a plurality of air conditioners including the measurement regarding the air conditioner, and further comprising flying the aircraft in accordance with the flight path in addition to the flight schedule.

20. The air conditioner management method according to claim 6, further comprising:

determining the flight schedule, transmitting the flight schedule, via a communication network, to the air conditioner and to the aircraft, receiving, via the communication network, from the aircraft, the measurement regarding the air conditioner, determining a state of the air conditioner, and initiating maintenance on the air conditioner based on the state which is determined.

* * * * *